US011207764B2

(12) United States Patent
Huang

(10) Patent No.: US 11,207,764 B2
(45) Date of Patent: Dec. 28, 2021

(54) TORQUE SOCKET TOOL

(71) Applicant: Hung-Wen Huang, Taichung (TW)

(72) Inventor: Hung-Wen Huang, Taichung (TW)

( * ) Notice: Subject to any disclaimer, the term of this patent is extended or adjusted under 35 U.S.C. 154(b) by 189 days.

(21) Appl. No.: 16/739,625

(22) Filed: Jan. 10, 2020

(65) Prior Publication Data

US 2020/0298383 A1 Sep. 24, 2020

(30) Foreign Application Priority Data

Mar. 20, 2019 (TW) ..... 108109586

(51) Int. Cl.
*B25B 23/142* (2006.01)
*B25B 13/48* (2006.01)

(52) U.S. Cl.
CPC ..... *B25B 23/1427* (2013.01); *B25B 13/481* (2013.01)

(58) Field of Classification Search
CPC . B25B 23/1427; B25B 13/481; B25B 23/141; B25B 13/06; F16D 7/04–046; F16D 43/202–2026
USPC ..... 81/473, 475, 476, 477, 478
See application file for complete search history.

(56) References Cited

U.S. PATENT DOCUMENTS

2018/0223912 A1* 8/2018 Nino ..... A61B 17/16
2019/0321948 A1* 10/2019 Chuang ..... B25B 13/06

* cited by examiner

*Primary Examiner* — Joseph J Hail
*Assistant Examiner* — Caleb Andrew Holizna
(74) *Attorney, Agent, or Firm* — Muncy, Geissler, Olds & Lowe, P.C.

(57) ABSTRACT

A torque socket tool includes a main body, a driving portion, an abutting member, an axle, and a sleeve member. The main body defines an axial direction. The abutting member is non-rotatably and slidably arranged in the main body. The sleeve member is rotatably sleeved onto the main body. A threaded section drives the abutting member to slide along the axial direction for adjusting the predetermined torque when the axle is rotated by rotating the sleeve member.

10 Claims, 5 Drawing Sheets

TORQUE SOCKET TOOL

BACKGROUND OF THE INVENTION

Field of the Invention

The present invention relates to a torque socket tool.

Description of the Prior Art

A torque tool is suitable for various needs by setting the appropriate torque. A conventional torque tool has a driving head at an end of the main body thereof, and a torque adjusting mechanism is arranged in the main body with a rotatable handle or rotation ring for alternating the torque. When the handle or the rotation ring is rotated, the torque adjusting mechanism moves axially due to the threaded structure. Thereby, the torque is adjusted.

However, the conventional torque adjusting mechanism has a larger volume, and the length of the torque tool is quite long to be difficult to be used in narrow spaces. In addition, the torque tool is difficult to store.

SUMMARY OF THE INVENTION

The main object of the present invention is to provide a torque socket tool having smaller length to be able to be used in narrow spaces. In addition, the torque socket tool is easy to store.

To achieve the above and other objects, the torque socket tool of the present invention includes a main body, a driving portion, an abutting member, an axle, and a sleeve member.

The main body defines an axial direction. The driving portion is received in the main body and is rotatable with respect to the main body along the axial direction. The driving portion idles when a torque larger than a predetermined torque is exerted thereon. The driving portion has a connecting hole at an end thereof for a tool to engage with. The connecting hole has a non-circular cross-section. An elastic member is arranged at an other end of the driving portion. The predetermined torque is alternated by adjusting a compression of the elastic member. The abutting member is non-rotatably and slidably received in the main body. A receiving room is formed on the abutting member toward the driving portion. An end of the elastic member opposite to the driving portion is inserted into the receiving room and abuts against the abutting member. The abutting member is further formed with a threaded hole. The axle is received in the main body and rotatable with respect to the main body. The axle has a threaded section for being screwed with the threaded hole. The sleeve member is rotatably sleeved onto the main body and is non-rotatablty connected to an end of the axle away from the threaded section. The axel is rotated when the sleeve member is rotated so that the threaded section drives the abutting member slide along the axial direction to adjust the predetermined torque.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
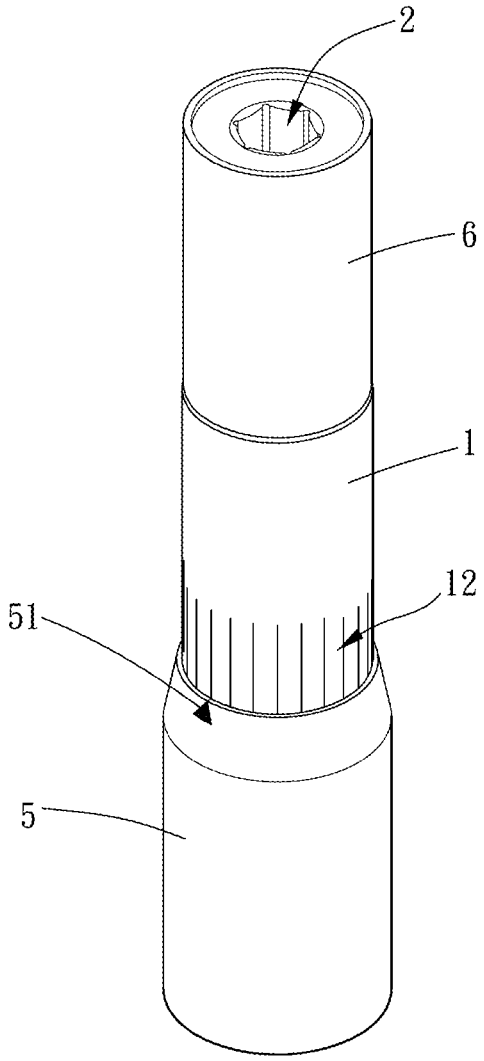
FIG. 1 is a stereogram of the present invention.
Figure 2:
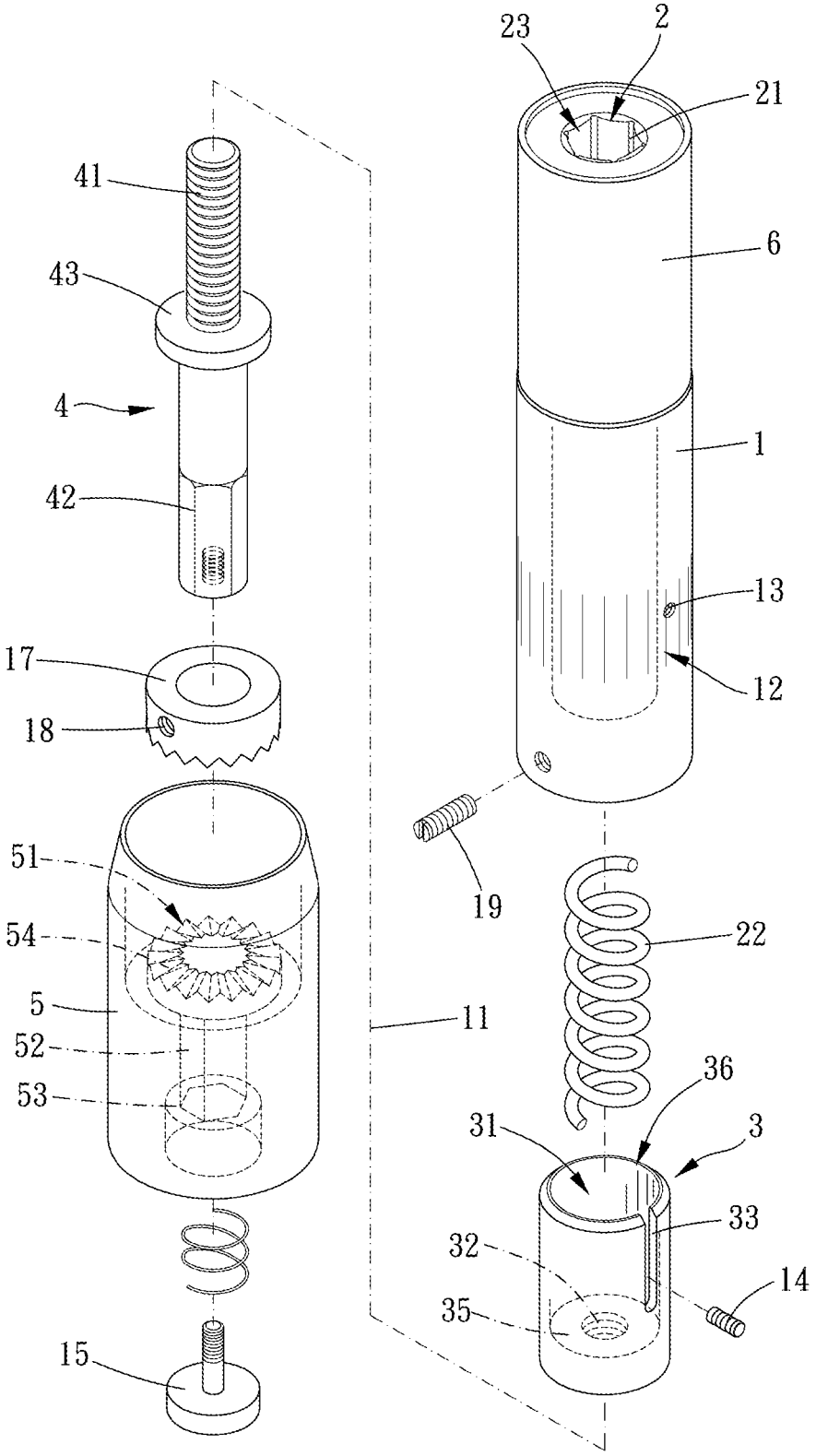
FIG. 2 is a breakdown drawing of the present invention.
Figure 3:
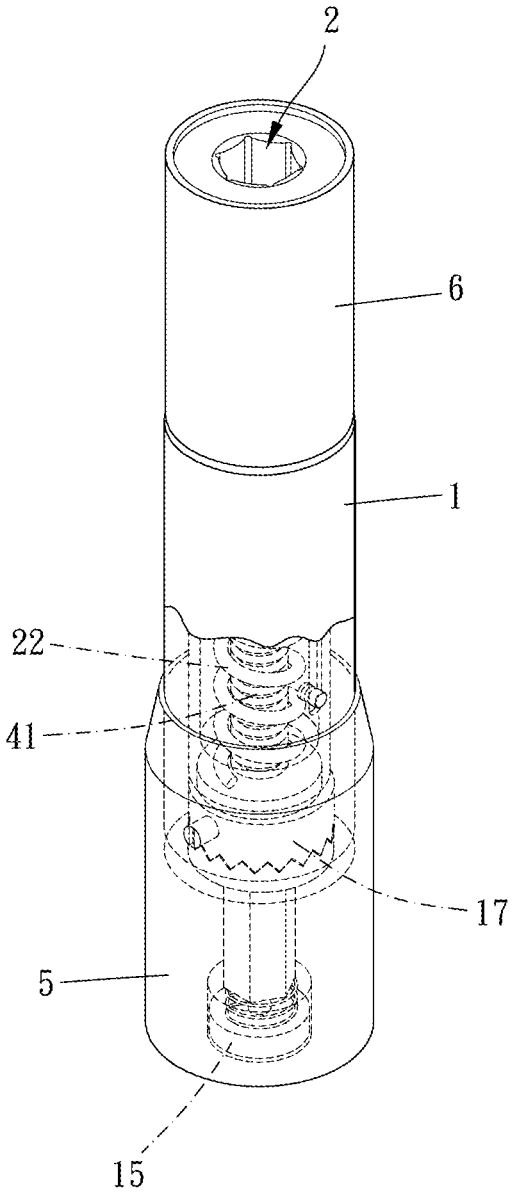
FIG. 3 is a partial perspective view of the present invention.
Figure 4:
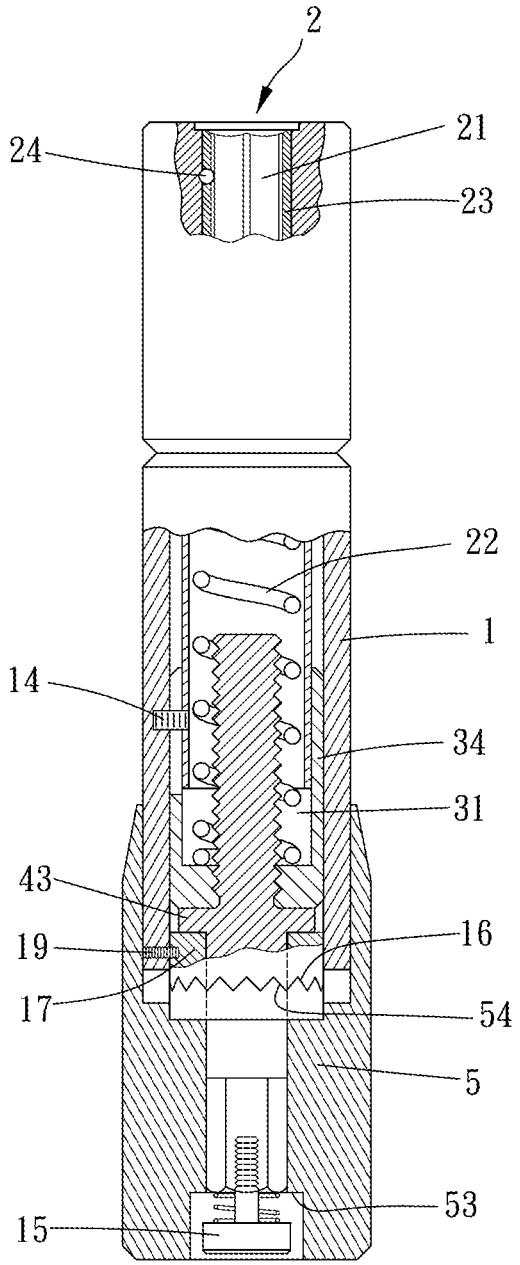
FIG. 4 and FIG. 5 are profiles of the present invention.
Figure 5:
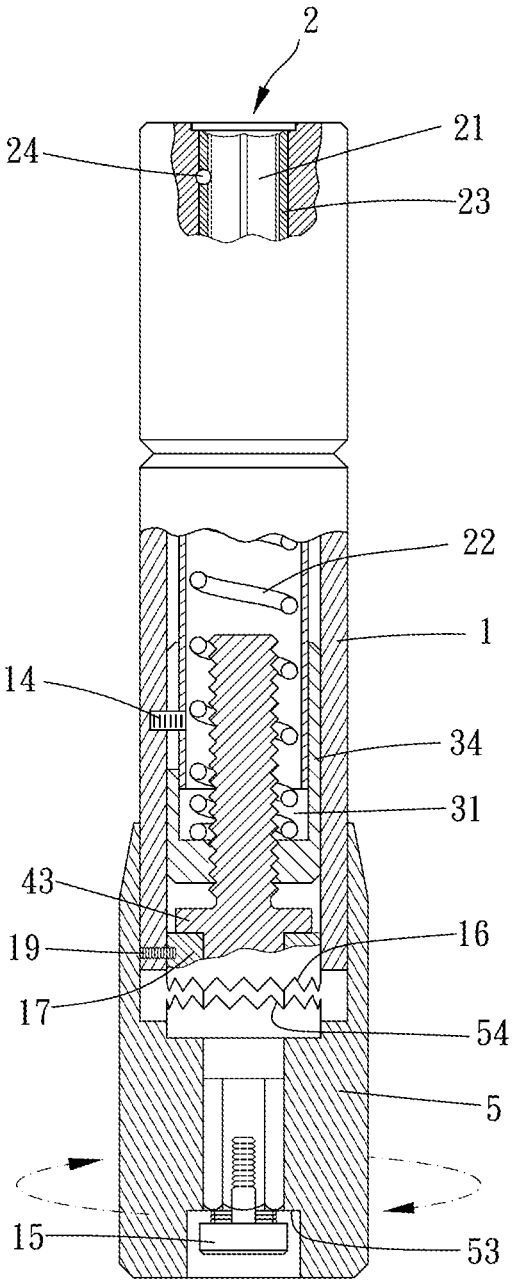

Please refer to FIG. 1 to FIG. 5, the torque socket tool of the present invention includes a main body 1, a driving portion 2, an abutting member 3, an axle 4, and a sleeve member 5.

The main body 1 defines an axial direction 11. The driving portion 2 is received in the main body 1 and is rotatable with respect to the main body 1 along the axial direction 11. The driving portion 2 idles when a torque larger than a predetermined torque is exerted thereon. The driving portion 2 has a connecting hole 21 at an end thereof for a tool (such as a screwdriver bit) to engage with. The connecting hole 21 has a non-circular cross-section (hexagon in the present embodiment). An elastic member 22 is arranged at an other end of the driving portion 2. The predetermined torque is alternated by adjusting a compression of the elastic member 22. In the present embodiment, the driving portion 2 further includes a socket 23, and the connecting hole 21 is formed on the socket 23. A locking member 24 is arranged on a wall of the socket 23. A tube member 6 is sleeved onto the socket 23 and the locking member 23. The locking member 24 is adapted for coupling with a recess on the tool so as to prevent the tool from detaching.

The abutting member 3 is non-rotatably and slidably received in the main body 1. A receiving room 31 is formed on the abutting member 3 toward the driving portion 2. An end of the elastic member 22 opposite to the driving portion 2 is inserted into the receiving room 31 and abuts against the abutting member 3. The abutting member 3 is further formed with a threaded hole 32.

The axle 4 is received in the main body 1 and rotatable with respect to the main body 1. The axle 4 has a threaded section 41 for being screwed with the threaded hole 32.

The sleeve member 5 is rotatably sleeved onto the main body 1 and is non-rotatablty connected to an end of the axle 4 away from the threaded section 41. The axel 4 is rotated when the sleeve member 4 is rotated so that the threaded section 41 drives the abutting member 3 slide along the axial direction to adjust the predetermined torque.

Because an end of the elastic member 22 is inserted into the receiving room 31 and abuts against the abutting member 3, the length of the receiving room 31 is the length that the torque socket tool can be shortened. Thereby, the torque socket tool can have a smaller length under a same torque to be suitable to use in narrow spaces and easy to store.

Preferably, one of an outer wall of the main body 1 and an outer wall of the sleeve member 5 has a graduation portion 12 extending circumferentially, and the other one of the outer wall of the main body 1 and the outer wall of the sleeve member 5 has an indication portion 51 corresponding to the graduation portion 12. In the present embodiment, the graduation portion 12 is formed on the outer wall of the main body 10, and the indication portion 51 which is arrow-shaped is formed on the outer wall of the sleeve member 5. The predetermined torque can be read from the graduation portion 12 and the indication portion 51 so that the user can easily adjust the predetermined torque. In addition, the graduation portion 12 and the indication portion 51 are easy to process so as to reduce the cost.

Specifically, the main body 1 is formed with a first insertion hole 13 extending along a radial direction. The abutting member 3 is formed with a sliding slot 33 extending along the axial direction 11. A first pin 14 is inserted through the sliding slot 33 and the first insertion hole 13. The abutting member 3 is slidable but not rotatable with respect to the main body 1.

Specifically, the abutting member 3 includes a circumferential wall 34 and a bottom wall 35 formed integrally. The receiving room 31 is enclosed by the circumferential wall 34. The bottom wall 35 is connected to an end of the circumferential wall 34 away from the driving portion 2. An opening 36 is enclosed by an end of the circumferential wall 34 closer to the driving portion 2. The elastic member 22 abuts against the bottom wall 35. The sliding slot 33 is formed on the circumferential wall 34 and extends to the opening 36 so that the sliding slot 33 is easy to process.

More specifically, the axle 4 further has a non-circular section 42 at an end thereof away from the threaded section 41. The sleeve member 5 is formed with a through hole 52 extending along the axial direction 1. The through hole 52 has a shape corresponding to the non-circular section 42. The non-circular section 42 is slidably inserted into the through hole 52, and the axle 4 is non-rotatable with respect to the sleeve member 5. Besides, an end of the through hole 52 away from the driving portion 2 communicates a first stepped portion 53 having a larger diameter. A fixing member 15 is engaged with the non-circular section 42 along the axial direction 11 and abuts against the first stepped portion 53 to prevent the sleeve member 5 from detaching from the axle 4.

The sleeve member 5 is movable along the axial direction 11 with respect to the axle 4 between a lock position and a release position. The main body 1 has a first engaging portion 16 along the axial direction 11. The sleeve member 5 has a second engaging portion 54 along the axial direction 11. When the sleeve member 5 is located at the lock position, the first engaging portion 16 and the second engaging portion 54 are engaged so that the sleeve member 5 is immovable with respect to the main body 1. When the sleeve member 5 is located at the release position, the first engaging portion 16 and the second engaging portion 54 are not engaged together so that the sleeve member 5 is rotatable with respect to the main body 1 for adjusting the predetermined torque.

Specifically, the main body 1 has an engaging member 17 therein. The engaging member 17 has the first engaging portion 16 at an end thereof facing the sleeve member 5. The engaging member 17 is further formed with a second insertion hole 18 extending along a radial direction. A second pin 19 is inserted through the second insertion hole 18 and the engaging member 17. Thus, it is not necessary to form the first engaging member 17 integrally on the main body 1. The cost of manufacturing the main body 1 is reduced by only adding the engaging member 17 and the second pin 19.

In the present embodiment, the axle 4 is formed with a flange 43 extending radially. The flange 43 is located between the threaded section 41 and the non-circular section 42. The flange 43 abuts against an end of the engaging member 17 facing the driving portion 2 to prevent the axle 4 from moving away from the driving portion 2 and further detaching from the main body 1.

In conclusion, the length of the elastic member does not have to been changed to reduce the length of the torque socket tool under a same torque. Thus, the torque socket tool of the present invention can be used in narrow spaced and is easy to store.

In addition, the graduation portion and the indication portion for indicating the predetermined torque are easy to be processed so that the cost is reduced.

What is claimed is:

1. A torque socket tool, including:

a main body, defining an axial direction;

a driving portion, received in the main body and rotatable with respect to the main body along the axial direction, the driving portion idling when a torque larger than a predetermined torque is exerted thereon, the driving portion having a connecting hole at an end thereof for a tool to engage with, the connecting hole having a non-circular cross-section, an elastic member being arranged at an other end of the driving portion, the predetermined torque being alternated by adjusting a compression of the elastic member;

an abutting member, non-rotatably and slidably received in the main body, a receiving room being formed on the abutting member toward the driving portion, an end of the elastic member opposite to the driving portion being inserted into the receiving room and abutting against the abutting member, the abutting member being further formed with a threaded hole;

an axle, received in the main body and rotatable with respect to the main body, the axle having a threaded section for being screwed with the threaded hole;

a sleeve member, rotatably sleeved onto the main body and non-rotatablty connected to an end of the axle away from the threaded section, the axel being rotated when the sleeve member is rotated so that the threaded section drives the abutting member slide along the axial direction to adjust the predetermined torque.

2. The torque socket tool of claim 1, wherein one of an outer wall of the main body and an outer wall of the sleeve member has a graduation portion extending circumferentially, the other one of the outer wall of the main body and the outer wall of the sleeve member has an indication portion corresponding to the graduation portion.

3. The torque socket tool of claim 1, wherein the main body is formed with a first insertion hole extending along a radial direction, the abutting member is formed with a sliding slot extending along the axial direction, a first pin is inserted through the sliding slot and the first insertion hole.

4. The torque socket tool of claim 3, wherein the abutting member includes a circumferential wall and a bottom wall formed integrally, the receiving room is enclosed by the circumferential wall, the bottom wall is connected to an end of the circumferential wall away from the driving portion, an opening is enclosed by an end of the circumferential wall closer to the driving portion, the elastic member abuts against the bottom wall, the sliding slot is formed on the circumferential wall and extends to the opening.

5. The torque socket tool of claim 1, wherein the axle further has a non-circular section at an end thereof away from the threaded section, the sleeve member is formed with a through hole extending along the axial direction, the through hole has a shape corresponding to the non-circular section, the non-circular section is slidably inserted into the through hole.

6. The torque socket tool of claim 5, wherein an end of the through hole away from the driving portion communicates a first stepped portion having a larger diameter, a fixing member is engaged with the non-circular section along the axial direction and abuts against the first stepped portion.

7. The torque socket tool of claim 5, wherein the sleeve member is movable along the axial direction with respect to the axle between a lock position and a release position, the main body has a first engaging portion along the axial direction, the sleeve member has a second engaging portion along the axial direction; when the sleeve member is located at the lock position, the first engaging portion and the second engaging portion are engaged so that the sleeve member is immovable with respect to the main body; when the sleeve member is located at the release position, the first engaging portion and the second engaging portion are not engaged together so that the sleeve member is rotatable with respect to the main body.

8. The torque socket tool of claim 7, wherein the main body has an engaging member therein, the engaging member has the first engaging portion at an end thereof facing the sleeve member, the engaging member is further formed with a second insertion hole extending along a radial direction, a second pin is inserted through the second insertion hole and the engaging member.

9. The torque socket tool of claim 8, wherein the axle is formed with a flange extending radially, the flange is located between the threaded section and the non-circular section, the flange abuts against an end of the engaging member facing the driving portion.

10. The torque socket tool of claim 1, wherein the driving portion includes a socket, the socket has the connecting hole, a locking member is arranged on a wall of the socket, a tube member is sleeved onto the socket and the locking member.

* * * * *